US005566860A

United States Patent [19]

Schiltz et al.

[11] Patent Number: 5,566,860

[45] Date of Patent: Oct. 22, 1996

[54] DUAL COMPONENT CARTRIDGE

[75] Inventors: William C. Schiltz, Canton; Frederick D. Wasmire, Alliance, both of Ohio

[73] Assignee: Liquid Control Corporation, North Canton, Ohio

[21] Appl. No.: 303,083

[22] Filed: Sep. 8, 1994

[51] Int. Cl.[6] ..... B65D 35/22

[52] U.S. Cl. ..... 222/94; 222/95; 222/105; 222/137; 222/145.6; 222/327; 222/390; 222/459

[58] Field of Search ..... 222/94, 95, 105, 222/137, 145.1, 145.5, 145.6, 326, 327, 386, 389, 390, 459

[56] References Cited

U.S. PATENT DOCUMENTS

| | | | |
|---|---|---|---|
| 3,176,595 | 4/1965 | Schwartz | 222/386 X |
| 4,366,919 | 1/1983 | Anderson | 222/137 |
| 4,386,717 | 6/1983 | Koob | 222/94 |
| 4,566,610 | 1/1986 | Herb | 222/145.5 X |
| 4,676,657 | 6/1987 | Botrie | 366/177 |
| 4,690,306 | 9/1987 | Stäheli | 222/137 X |
| 4,735,509 | 4/1988 | Rausch | 366/333 |
| 4,846,373 | 7/1989 | Penn et al. | 222/137 |
| 5,033,650 | 7/1991 | Colin et al. | 222/145.6 X |
| 5,080,262 | 1/1992 | Herold et al. | 222/145.6 X |
| 5,184,757 | 2/1993 | Giannuzzi | 222/94 |
| 5,295,613 | 3/1994 | Barthomeuf et al. | 222/137 |
| 5,301,842 | 4/1994 | Ritter | 222/145.1 X |
| 5,370,273 | 12/1994 | Rohloff et al. | 222/145.1 X |

*Primary Examiner*—Joseph Kaufman
*Attorney, Agent, or Firm*—Sand & Sebolt

[57] ABSTRACT

A cartridge for use in a dispensing gun for simultaneously dispensing and mixing a pair of chemically reactive fluid components maintained in separate chambers in the cartridge. One of the fluid components is contained in an elongated tube formed of a thin flexible film which is placed within a first chamber located either coaxially within an outer annular second chamber containing the other fluid component, or in a side-by-side relationship to the second chamber. Pistons are slidably mounted within the two chambers for simultaneously dispensing the fluid components therefrom when moved forward by plungers of the dispensing gun. In a first embodiment, the front end surface of one of the pistons is recessed from an outer end surface of the other piston to form a void space for collecting the collapsed flexible film therein to permit the outer piston to reach the full extent of its stroke and expel all of the fluid components from both the chambers. In a second embodiment, the first chamber containing the flexible film extends forwardly beyond the second chamber forming a void space beyond an end wall of the second chamber for collecting the collapsed compacted film.

21 Claims, 5 Drawing Sheets

DUAL COMPONENT CARTRIDGE

BACKGROUND OF THE INVENTION

Technical Field

The invention relates to dispensing a plurality of fluid materials, which when mixed together, chemically react to produce a desired end product such as an adhesive, potting compound, sealer, encapsulate, or the like. More particularly, the invention relates to a cartridge for containing and dispensing two fluid components in preset amounts, which components are maintained separate until they are mixed prior to being discharged from the cartridge through a mixing nozzle. Even more particularly, the invention relates to such a cartridge which stores one of the fluid components in a flexible film package which may be stored entirely separate from the cartridge to prevent any possibility of cross contamination of the two components prior to their use, and wherein a void space is created at the discharge end of the cartridge to collect the collapsed film to enable both fluid components to be completely dispensed from the cartridge.

Background Information

Various types of dispensers have been developed for dispensing a volume of fluid materials, such as chemically reactive resins or resins and a hardener, which materials must be maintained out of contact with each other within the dispenser so that when mixed, they chemically react to form a final product. It is desirable that the dispenser dispenses the two materials in a preset, accurately controlled relationship to ensure that the proper chemical reaction takes place when forming the final product, since the final product can be greatly affected by an unbalanced ratio of the two component products.

These two components preferably are maintained in cartridges for storage, shipment and sale, which cartridges are then placed in a dispensing gun. The gun usually has a pneumatic, hydraulic, manual or other type of actuation system for simultaneously dispensing the two fluid components from the cartridges. Due to the reactive nature of some chemical components which are stored in the cartridges, it has been found desirable to store one of the components completely separate and removed from the cartridge in a package formed of a flexible film material, commonly referred to as a "sausage" or "chub" in the dispensing industry. These film cartridges prevent the premature interaction of the two components within the cartridge prior to use, and prevents one of the fluid components from affecting the cartridge material if stored for relatively long periods of time in various types of environments. Examples of cartridges utilizing flexible film containers or packages are shown in U.S. Pat. Nos. 4,676,657 and 4,735,509.

However, one problem encountered with cartridges utilizing flexible film storage containers or packages is that upon dispensing the fluid component from the film container, the collapsed film occupies a small amount of space at the discharge end of the cartridge, which prevents a movable dispensing piston within the other container or chamber from completely dispensing all of the second fluid component from the other chamber. This results in a small amount of fluid component being discarded with the empty cartridge, which if the particular fluid component falls within a certain category of material, it is designated as a hazardous material. This creates disposal problems in addition to the wasting of material, since a certain quantity thereof will always remain in the exhausted cartridge. This residual fluid component remaining in the cartridge also results in a substantial cost over extended periods of time in certain industries which use a relatively large number of such cartridges.

Therefore, the need exists for an improved two-component cartridge in which one of the components is maintained in a flexible film package, which cartridge includes means for discharging the entire contents of both of the fluid components upon collapsing of the film package within the cartridge.

SUMMARY OF THE INVENTION

Objectives of the invention include providing an improved two component cartridge for simultaneously dispensing two fluid chemically reactive components for subsequent joining and mixing in a discharge nozzle in a simple and inexpensive cartridge.

A further objective of the invention is to provide such a cartridge in which one of the fluid components is contained in an elongated tubular package formed of a flexible film, which when completely collapsed, is contained within a void space formed in a forward end of the cartridge, which enables the dispensing pistons to completely discharge all of the fluid components from within the cartridge, avoiding residual amounts of such fluid components from remaining in the cartridge after the pistons have reached their full discharge positions.

A still further objective of the invention is to provide such a cartridge in which a single force can be applied on pistons at a rear end of the cartridge by a dispensing gun for simultaneously moving the pistons coaxially or in a side-by-side relationship within the cartridge for dispensing the two flowable components from their respective chambers in the desired amount, whereupon the components are joined, preferably at the inlet end of a static mixer, which is attached to a discharge end or nozzle of the cartridge for providing the desired mixture of the two components.

Still another objective of the invention is to provide such a cartridge in which the discharge pistons includes inner and outer pistons preferably formed of a relatively inexpensive plastic material or other types of materials which are unaffected by the particular material stored within the cartridge, and which can be provided with flexible sealing skirts which will effectively seal against the inner and outer walls of the internal chambers when dispensing the fluid components from their respective chambers.

These objectives and advantages are obtained by the two component cartridge of the present invention, the general nature of which may be stated as including a body having a forward discharge end and a rear end, and first and second chambers for containing the two fluid components separate from each other prior to dispensing said components from said chambers; a dispensing nozzle extending from the forward end of the body; first and second pistons located within the first and second chambers, respectively, and movable from adjacent the rear end of the body toward the discharge end for simultaneously discharging the two fluid components from interiors of said chambers and outwardly through the nozzle; a collapsible container formed of a thin flexible film for storing a first fluid component of said two fluid components within the first chamber; and means forming a void space in the first chamber adjacent the forward end of the body having a sufficient volume for collecting the flexible film therein after both of the pistons have reached said forward end wall to dispense substantially all of the fluid components from the chambers and the first piston has compacted the film in said void space.

BRIEF DESCRIPTION OF THE DRAWINGS

Preferred embodiments of the invention, illustrative of the best modes in which applicants have contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

Figure 1:
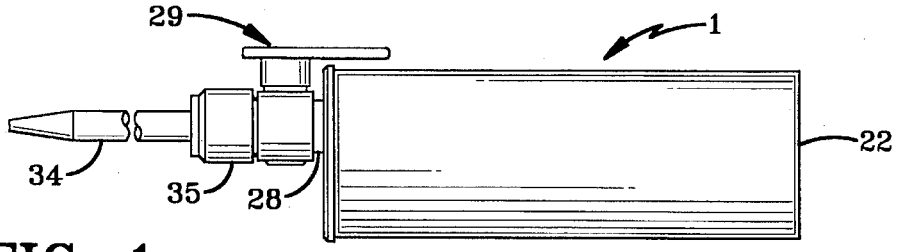
FIG. 1 is a top plan view of a first embodiment of the improved two component cartridge of the present invention.
Figure 2:
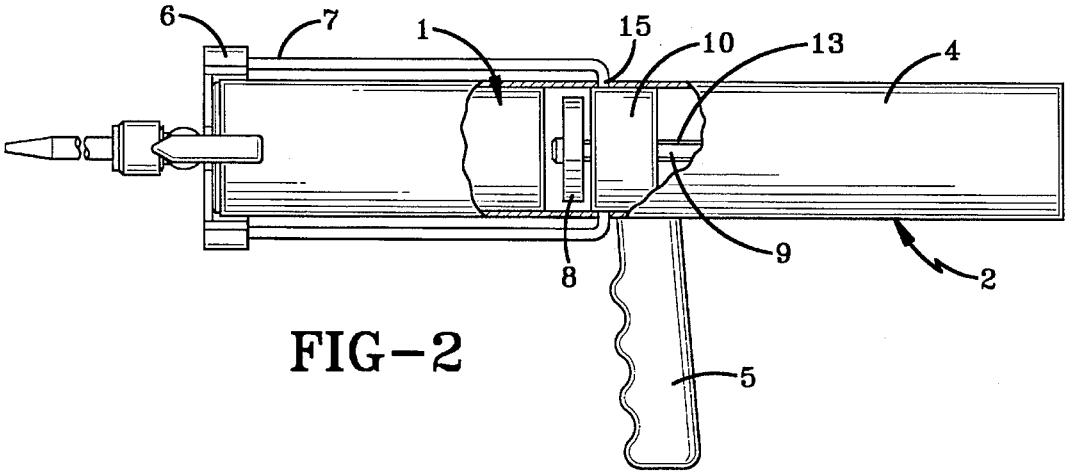
FIG. 2 is a side elevational view with portions broken away and in section, showing the cartridge of FIG. 1 mounted within a dispensing gun.

A first embodiment of the improved two-component cartridge of the present invention is indicated generally at 1, and is shown in FIG. 1, and is shown in FIG. 2 mounted within one type of dispensing gun 2. Gun 2 can be various types of devices for exerting a dispensing force on cartridge 1. One type of dispensing gun 2 is sold under the trademark SUPERMIX II by Liquid Control Corporation of Canton, Ohio. Gun 2 consists of a main cylindrical tubular housing 4 (FIG. 2) and has a handle 5 secured thereto and extending generally transversely from tube 4 for manually gripping by an operator of gun 2. A cartridge retainer 6 is movably mounted on housing 4 by a pair of cartridge rods 7 which are pivotally mounted at 15 to the gun housing. As shown in FIGS. 2, 9, 10 and 11, gun 2 has an annular outer piston 8 to which are connected two outer piston rods 9. Rods 9 are slidably movably mounted in a piston guide 10 which is mounted in a fixed position within housing 4. Gun 2 further includes an inner piston 12 and a piston rod 13, also slidably mounted within piston guide block 10.

Cartridge 1 is removably mounted within the forward or front end of housing 4 by retainer 6 and is acted upon by outer and inner pistons 8 and 12, as described further below, for simultaneously dispensing a pair of fluid components stored within cartridge 1. Other types of dispensing gun constructions may be used with cartridge 1 other than that shown in FIGS. 2, 9 and 10, without affecting the concept of the invention. These dispensing guns could be electrically, pneumatically, hydraulically, or even manually operated for supplying a sufficient force to pistons 8 and 12 for discharging the contents of cartridge 1.

Figure 3:
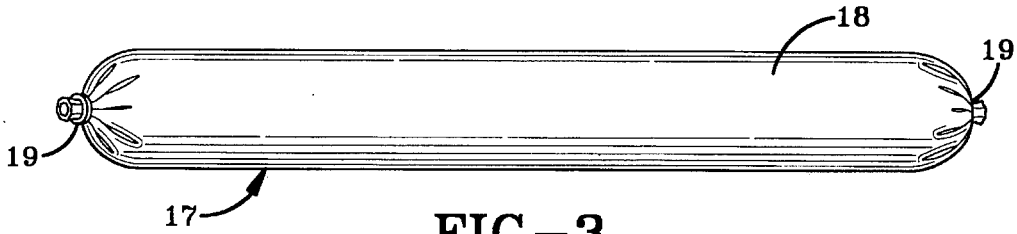
FIG. 3 is an enlarged elevational view of a tubular plastic bag or package containing one of the components for use in the cartridge of FIG. 1.

In accordance with one of the features of the invention, a first fluid component 38 is stored within a tubular package 17 (FIG. 3) which is formed of a thin flexible film material 18 having an elongated cylindrical configuration, with its ends being closed by closure rings 19. Depending upon the particular material of film 18, it can be selected so as to be unaffected by the particular fluid material stored therein. Package 17 also provides an inexpensive means for storing one of the fluid components entirely separate from the other fluid component prior to incorporating it into dispensing gun 2, to prevent cross contamination of the components.

Referring particularly to FIGS. 1, 9, 10 and 11, cartridge 1 includes a tubular cylindrical body, indicated generally at 20, formed with a front closure wall 21 and an open rear end 22. A first or inner chamber 23 is formed within cylindrical body 20 by a cylindrical wall 24 which is connected to and extends from front wall 21 to the open end 22 coaxially within cylindrical body 20 which, in turn, forms a second or outer annular chamber 25, which surround inner chamber 23.

A neck portion 28 (FIGS. 9 and 10) is formed integrally with end wall 21 and extends forwardly therefrom and terminates in a discharge nozzle 27. Neck 28 may include a valve member, indicated generally at 29, which is rotatably mounted within the neck for controlling the flow of the two fluid components therethrough. Valve member 29 may be of the type shown in U.S. Pat. No. 4,846,373, the contents of which are incorporated herein by reference. Neck portion 28 is formed with a pair of material passageways 30 and 31, which communicate with inner and outer chambers 23 and 25, respectively, for permitting the flow of materials from the chambers through neck portion 28 and out of nozzle 27 and into a static mixer 34 which is threadedly removably mounted on cartridge 1 by a coupler 35. Static mixer 34 is of a usual construction and will include an internal helical mixer 36 which will mix the two fluid components as they leave neck portion 28 and nozzle 27 and move through the static mixer. One type of static mixer which can be utilized with cartridge 1 is shown in U.S. Pat. No. 4,014,463.

Figure 11:
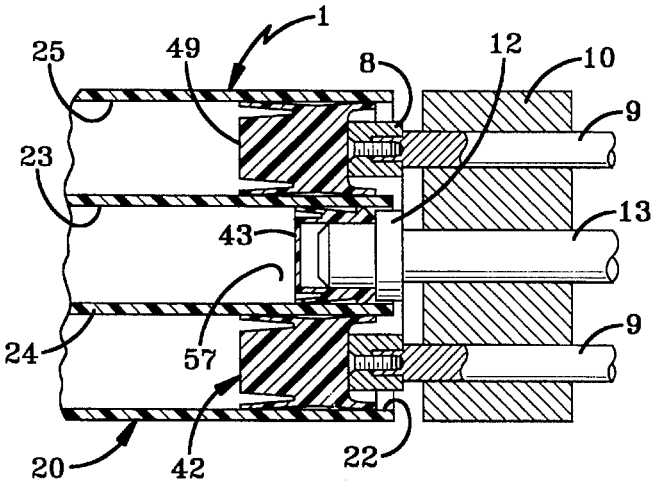
FIG. 11 is an enlarged fragmentary sectional view of the dispensing gun pistons engaged with the cartridge pistons at the rear of the cartridge without any fluid materials being shown in the cartridge.
Figure 7:
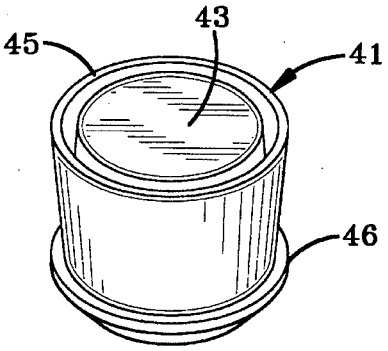
FIG. 7 is a front perspective view of the cartridge inner piston.
Figure 8:
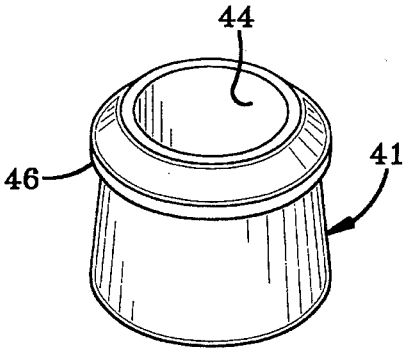
FIG. 8 is a rear perspective view of the inner piston of FIG. 7.
Figure 9:
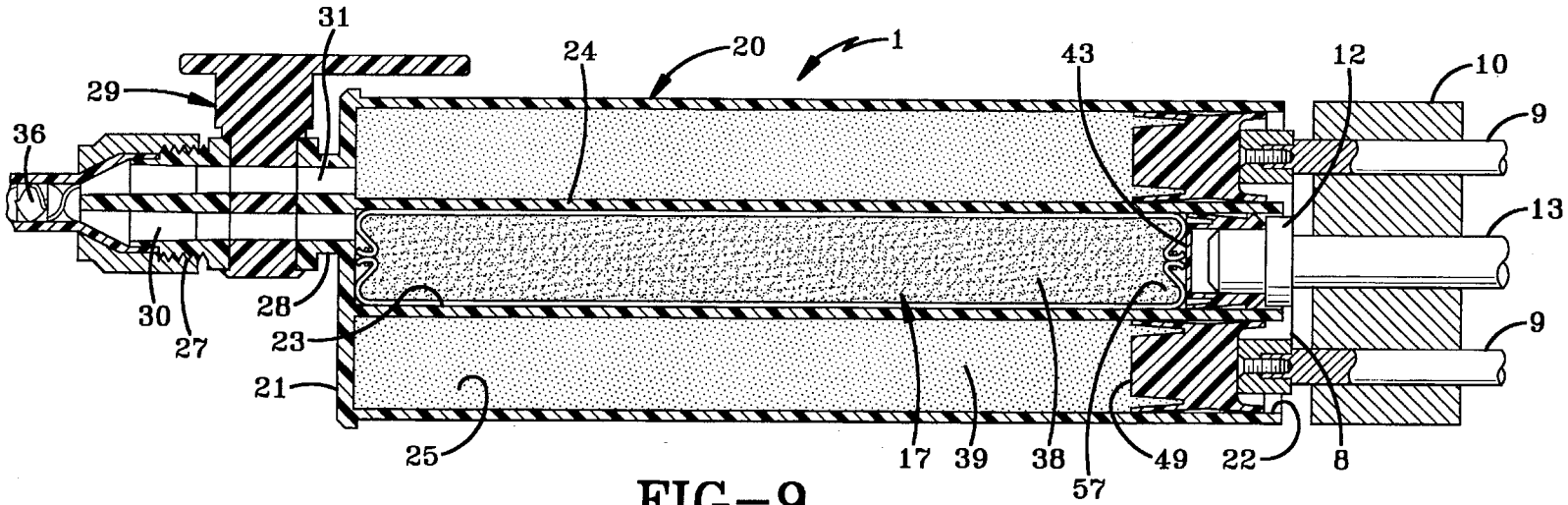
FIG. 9 is an enlarged fragmentary sectional view of the cartridge of FIG. 1 with the inner and outer pistons of a dispensing gun shown engaged with the inner and outer cartridge pistons at the start of a dispense operation.
Figure 10:
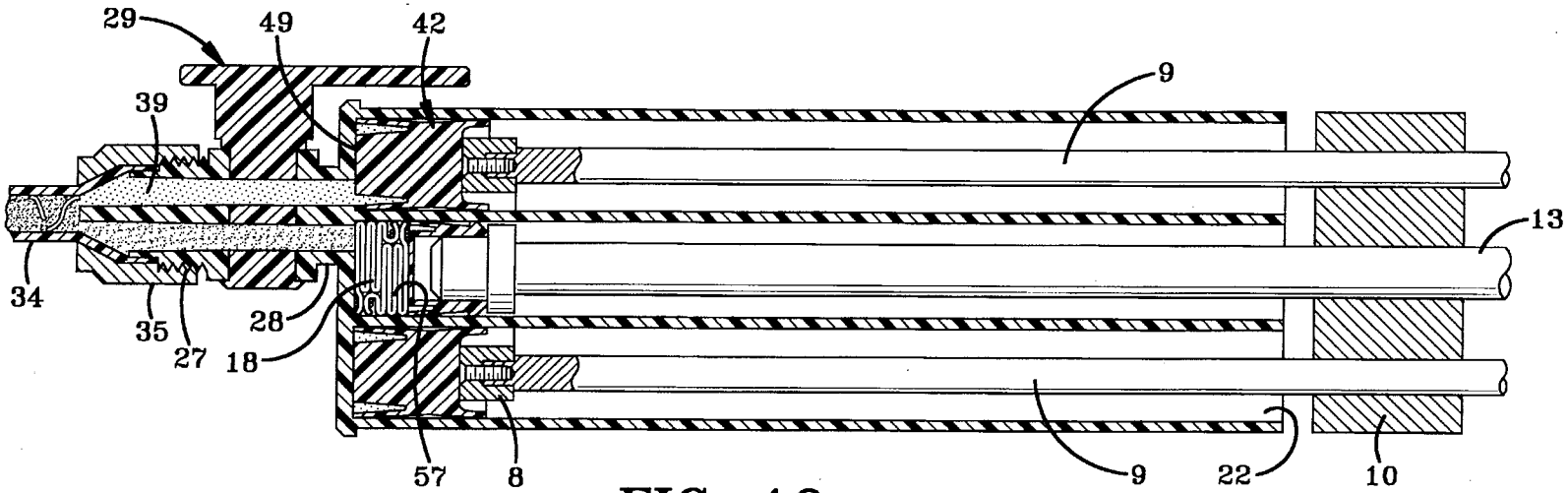
FIG. 10 is a sectional view similar to FIG. 9 showing the dispensing gun and the cartridge inner and outer pistons after the contents of the cartridge have been dispensed.

In accordance with the invention, inner and outer dispensing pistons, indicated generally at 41 and 42, respectively (FIGS. 7–8, FIGS. 4–6), are movably mounted within tubular housing 4 of cartridge 1. Inner piston 41 is slidably mounted within inner chamber 23, and includes a disc-shaped front surface 43 (FIG. 7) and a rear hollow portion 44 (FIG. 8), in which inner piston 12 of gun 2 is seated, as shown in FIGS. 9 and 11, for moving inner piston 41 forwardly within inner chamber 23 for dispensing fluid component 38 therefrom. A flexible annular skirt 45 forms the side wall of inner piston 41 and extends concentrically about front surface 43, and provides a sealing engagement with the inner surface of cylindrical wall 24 of inner chamber 23 as inner piston 41 moves forwardly therein, as shown in FIGS. 9 and 10. An annular ring 46 is formed at the rear end of piston 41 and assists in providing a sliding sealing engagement with cylindrical wall 24.

Outer piston 42 includes an annular front face 49 (FIG. 4) and a pair of inner and outer annular flexible sealing skirts 50 and 51. The inner diameter of flexible skirt 50 is complementary to the outer circumference of inner chamber forming cylindrical wall 24 so as to provide for a sliding sealing engagement therewith as outer piston 42 slidably moves within tubular cylindrical body 20, as shown in FIGS. 9 and 10. The rear portion of outer piston 42 also includes an annular flexible sealing skirt 53 and a flexible inner sealing skirt 54 to further provide for a sliding sealing engagement with the interior surface of tubular cylindrical body 20 and the outer surface of cylindrical wall 24, respectively, of inner chamber 23.

Figure 5:
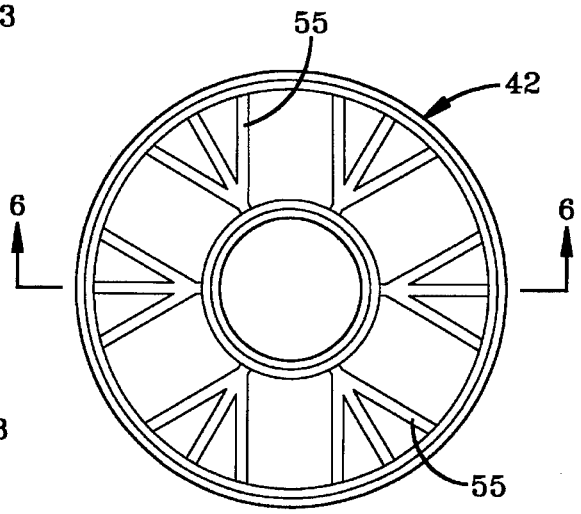
FIG. 5 is an end elevational view of the cartridge outer piston of FIG. 4, looking in the direction of arrows 5—5, FIG. 4.
Figure 6:
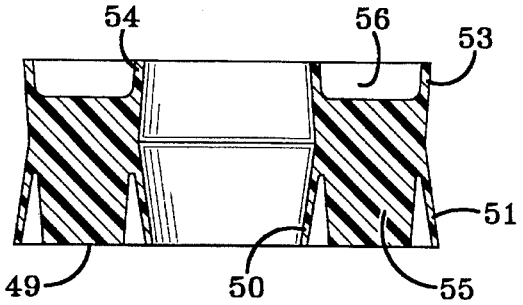
FIG. 6 is a sectional view taken on line 6—6, FIG. 5.

The interior of outer piston 42 is relatively hollow and is formed by a plurality of generally radially extending webs 55, as shown particularly in FIG. 5. The formation of outer piston 42 by webs 55 reduces the weight of the piston without sacrificing rigidity. It also reduces the cost thereof, by minimizing the amount of plastic material needed for forming the piston. Rear sealing skirts 53 and 54 (FIG. 6) form an annular recess 56 in which annular outer piston 8 of dispensing gun 2 seats, as shown in FIGS. 9–11, for pushing piston 42 forwardly within main tubular body 20 for dispensing of fluid component 39 from outer annular chamber 25.

In accordance with one of the main features of the invention, best shown in FIGS. 9–11, inner piston 41 is mounted with respect to outer piston 42 and is movable along the interior of tubular body 20 so as to be spaced rearwardly therefrom, forming an annular inner recess 57 created by spacing front surface 43 of inner piston 41 rearwardly of front annular surface 49. This recess 57 provides a void area or space for receiving the collapsed compacted flexible film of film 18 of package 17 when inner and outer pistons 41 and 42 are in their full forward position, as shown in FIG. 9. This relationship enables outer annular end face 49 of outer piston 42 to abut end wall 21 for discharging all of fluid component 39 from outer annular chamber 25.

Heretofore, where the end faces of the inner and outer pistons were generally aligned in the same plane and the chambers extended the same length within the cartridge, the collapsed condition of tubular package 17 would prevent the end face of the outer piston from abutting the end wall to completely discharge the contents of the outer chamber. However, the formation of void space 57 provides a collection space having a sufficient volume for containing the collapsed film 18, as shown in FIG. 10. This ensures that all of fluid component 39 is discharged from chamber 25, as well as all of fluid component 38 from within tubular package 17. Although the amount of fluid component 39 which would remain in the outer chamber if the end faces of the inner and outer pistons were aligned in the same plane is not an appreciable amount, this residual material may be classified as hazardous waste, requiring special handling and disposal.

Cartridge 1 can be mass produced in large quantities relatively inexpensively, preferably by molding the various components of plastic materials, which components can then be assembled rapidly with a minimum of manufacturing operation and fabrication, enabling the cartridge to be a throwaway item. Also, the various plastic materials can be chosen to avoid reaction with the particular fluid components in contact therewith. However, if desired, the cartridge can be cleaned of any remaining fluid components for subsequent refilling of outer chamber 25 with fluid component 39, after which outer piston 42 is placed within open end 22 of the cartridge for sealing the outer fluid component therein.

Just prior to using cartridge 1, tubular package 17 containing reactive component 38 can be slidably inserted within inner chamber 23. This enables the reactive component 38, to be completely out of contact with and stored in a completely separate location from that of the fluid component 39, to prevent any possible interaction therebetween until just prior to placing cartridge 1 in dispensing gun 2. This also enables cartridge 1 to contain various fluid components 39, with a variety of fluid components 38 being used therewith by selecting the appropriate flexible tubular package 17 for placement within the inner chamber. Thus, this provides interchangeability and mixing of the two components just prior to placing of the final component 38 in the cartridge and subsequently in the dispensing gun, increasing the versatility thereof. This is in contrast to prior art dual-component cartridges in which both of the fluid components are placed within the cartridge at the time of assembly where the two components remain during shipment and storage until being used. This can create a situation where the two components may react through the intervening plastic of the inner chamber housing.

As shown in FIG. 11, front surface 43 of inner piston 41 is spaced rearwardly from the plane of the annular front face 49 of outer piston 42 which provides the void area 57 upon both pistons simultaneously reaching their forwardmost position adjacent end wall 21, as shown in FIG. 10, wherein flexible film 18 is compacted and contained in the void space after all of the contents are dispensed from the inner and outer fluid chambers.

Figure 12:
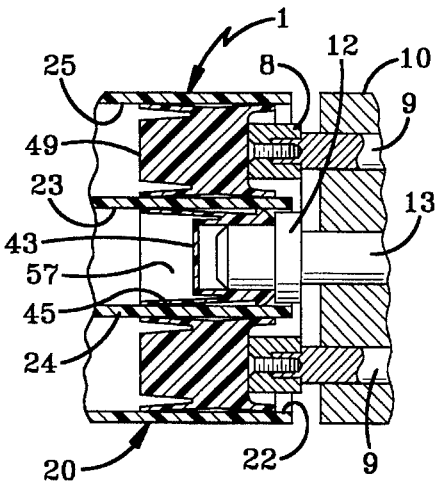
FIG. 12 is a fragmentary sectional view similar to FIG. 11 showing a modified form of the inner piston.
Figure 4:
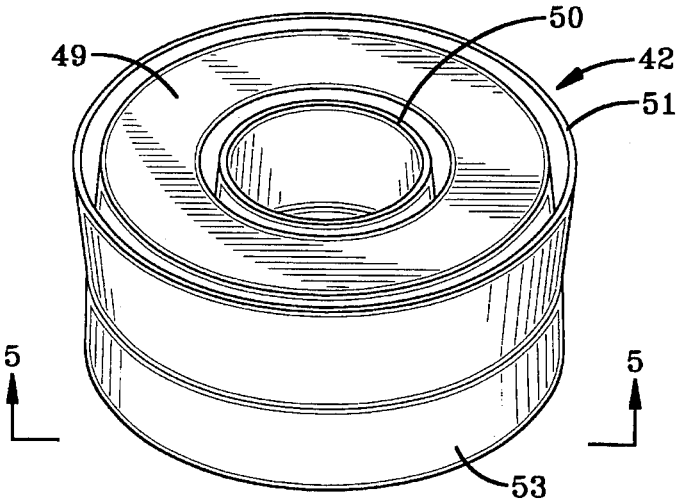
FIG. 4 is a greatly enlarged front perspective view of the outer dispensing piston removed from the cartridge of FIG. 1.

FIG. 12 discloses a piston arrangement quite similar to that shown in FIG. 11, with the exception that the flexible annular skirt 45 extends forwardly from front face 43 a greater distance than that shown in FIG. 11, thereby in essence forming a central recess within the inner piston which forms void space 57 for collecting the compacted collapsed film therein.

Figure 13:
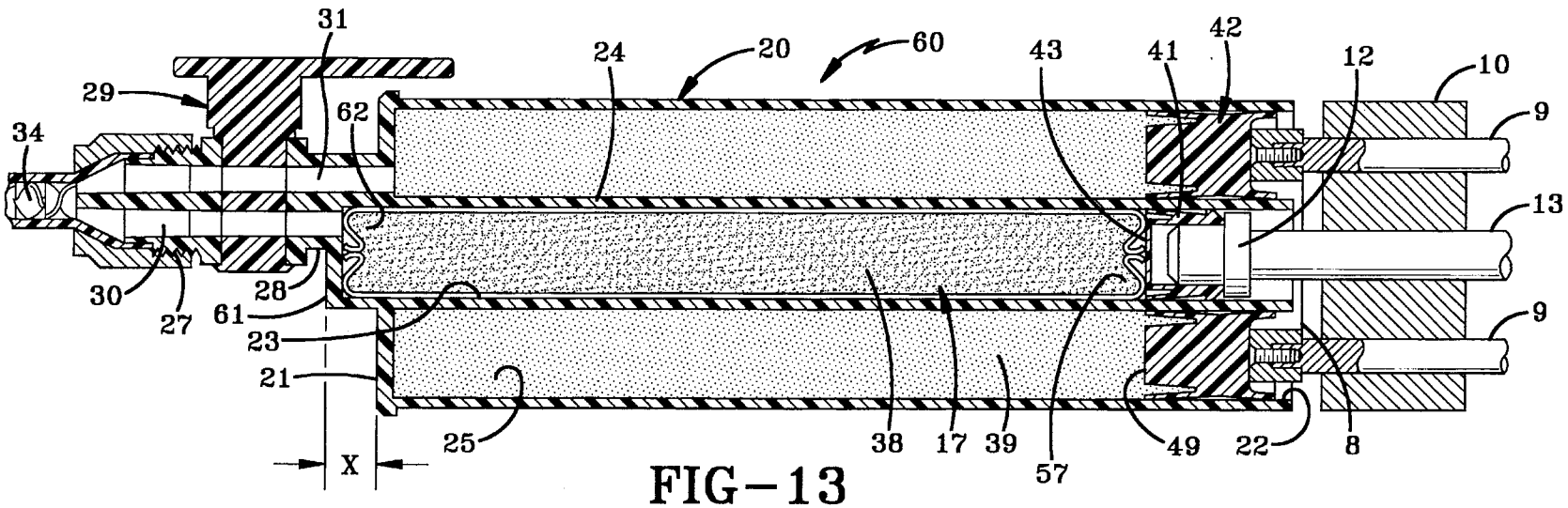
FIGS. 13 and 14 are fragmentary sectional views similar to FIGS. 9 and 10, respectively, of a second embodiment of the invention.
Figure 14:
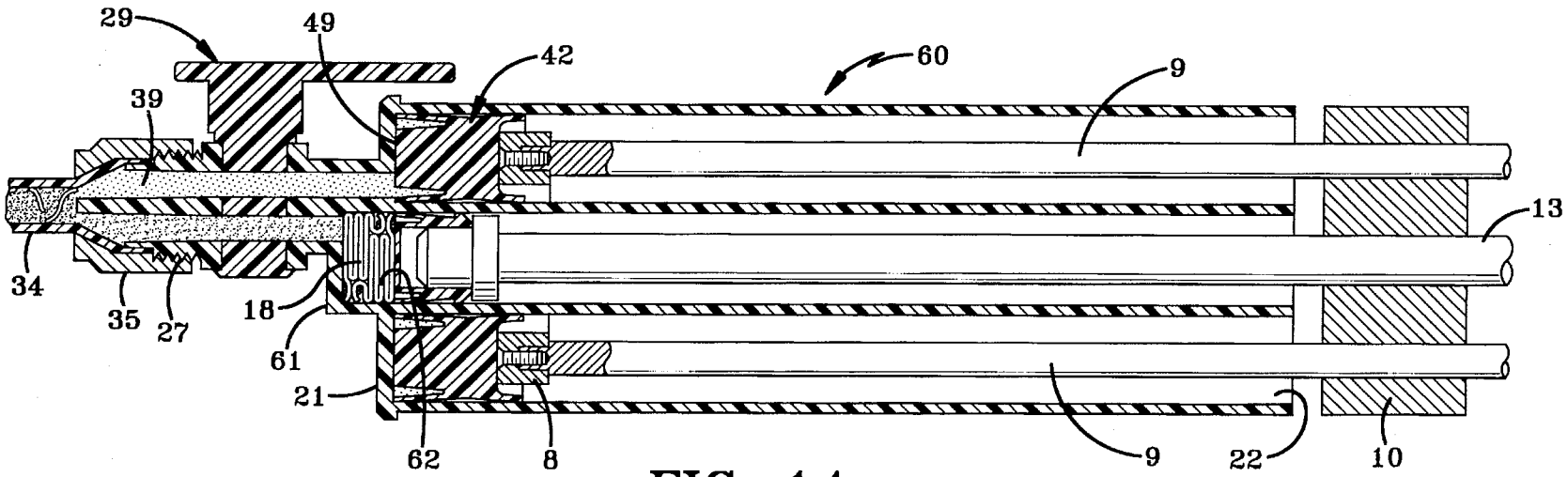

A second embodiment of the improved dual component cartridge of the invention is indicated generally at 60, and is shown in FIGS. 13 and 14. Cartridge 60 is similar to cartridge 1 described above with the main differences being that the end surface 43 of inner piston 41 lies in the same transverse plane as does end surface 49 of outer piston 42, which plane is transverse to the longitudinal axis of the cartridge. Furthermore, inner chamber 23 extends a distance "X" forwardly of end wall 21 terminating in an end wall portion 61, thereby forming an annular void space 62 forwardly of end wall 21 for receiving the collapsed compacted film 18 therein, as shown in FIG. 14, upon the end surfaces of both pistons simultaneously reaching the discharge or forward end of cartridge 60.

The operation and manner of use of cartridge 60 of FIGS. 13 and 14 is the same as that of cartridge 1 in that both pistons are moved simultaneously forwardly within their respective chambers for dispensing the fluid materials therefrom and into the static mixer 34.

Figure 15:
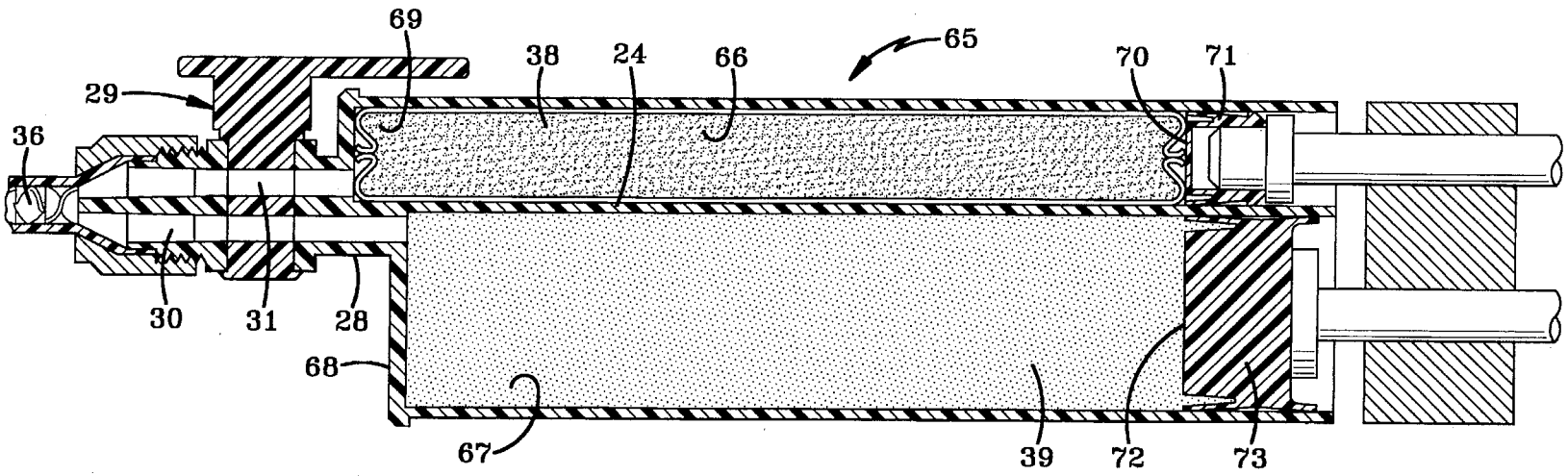
FIGS. 15 and 16 are sectional views similar to FIGS. 9–10 and FIGS. 13–14, respectively, of a still further embodiment of the present invention.
Figure 16:
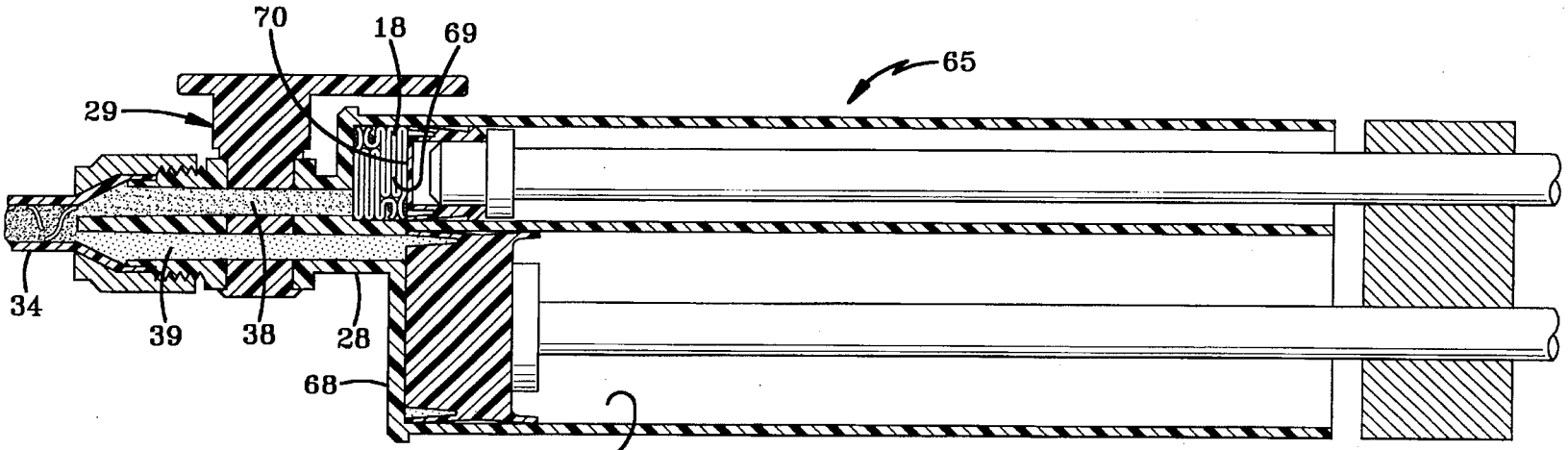

A third embodiment of the improved dual component cartridge is indicated generally at 65 and is shown in FIGS. 15 and 16. Cartridge 65 includes a first chamber 66 and a second chamber 67, which are mounted in a side-by-side longitudinally extending relationship, instead of a coaxial relationship, as are the chambers shown in the cartridges of FIGS. 9–10 and FIGS. 13–14. First chamber 66 will extend forwardly beyond end wall 68 of second chamber 67 so as to provide a void space 69 at the forward end of the cartridge for collecting the compacted collapsed film 18 therein upon both pistons reaching their forwardmost position to completely discharge the contents from both containers, as shown in FIG. 16. Outer end face 70 of a first piston 71 will lie in the same transverse plane as end face 72 of a second piston 73, as described above with respect to embodiment 60, so that upon end face 72 reaching end wall 68, the plastic film 18 will be fully compacted within void area 69, as shown in FIG. 16, thereby simultaneously dispensing the contents of both side-by-side chambers.

Accordingly, the improved two component cartridge, provides an effective, safe, inexpensive, and efficient device which achieves all the enumerated objectives, provides for eliminating difficulties encountered with prior cartridges, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved two component cartridge is constructed and used, the characteristics of the construction, and the advantageous, new and useful results obtained; the new and useful structures, devices, elements, arrangements, parts and combinations, are set forth in the appended claims.

We claim:

1. A cartridge for use in a dispensing gun for simultaneously dispensing first and second fluid components contained separately in said cartridge, said cartridge including:

a body having a forward discharge end and a rear end, and first and second chambers for containing the first and second fluid components, respectively, separate from each other prior to dispensing said components from said chambers;

a dispensing nozzle extending from the forward end of the body;

a collapsible container formed of a thin flexible film for placing and holding the first fluid component within the first chamber, with the second fluid component being freely contained within the second chamber;

first and second pistons located within the first and second chambers, respectively, and movable from adjacent the rear end of the body toward the discharge end for simultaneously discharging the fluid components from the flexible film and from the interior of the second chamber and outwardly through the nozzle; and means for forming a void space in the first chamber adjacent the forward end of the body having a sufficient volume for collecting the flexible film therein after both of the pistons have reached said forward end to dispense substantially all of the fluid components from the flexible film and from the second chamber, and the first piston has compacted the film in said void space.

2. The cartridge defined in claim 1 in which the first chamber is formed by a substantially cylindrical wall extending coaxially throughout the second chamber; and in which the second piston is annular and is slidably movable along the exterior of the cylindrical wall of the inner chamber.

3. The cartridge defined in claim 2 in which the first and second pistons include outer end faces; and in which the outer end face of the first piston is spaced rearwardly from the outer end face of the second piston which provides the means for forming the void space for collecting the flexible film upon said outer end faces of the pistons simultaneously reaching the forward end of the body.

4. The cartridge defined in claim 3 in which the body has a cylindrical tubular shape; in which the second piston has an annular front end surface which forms the outer end face; and in which the second piston further includes a pair of annular flexible sealing skirts located adjacent the annular end surface for providing a sliding sealing engagement with the cylindrical wall of the first chamber and with the tubular cylindrical body of the cartridge.

5. The cartridge defined in claim 4 in which the second piston includes an annular body having a plurality of generally radially extending webs of material joined with the annular end surface.

6. The cartridge defined in claim 2 in which the second piston is formed with an annular recess in a rear surface thereof for receiving a piston of a dispensing gun therein.

7. The cartridge defined in claim 6 in which the annular recess of the second piston rear surface is defined by a pair of spaced annular flexible sealing skirts.

8. The cartridge defined in claim 2 in which the first piston includes a disc-shaped front end surface surrounded by an annular flexible sealing skirt which provides a sliding sealing engagement with the cylindrical wall of the first chamber.

9. The cartridge defined in claim 8 in which the first piston further includes a substantially hollow rear portion for receiving a piston of a dispensing gun for slidably moving said first piston through the first chamber.

10. The cartridge defined in claim 2 in which the forward end of the cartridge body includes an end wall; and in which the first chamber extends forwardly beyond the said end wall a sufficient distance to form said void space forwardly of said end wall.

11. The cartridge defined in claim 10 in which the first and second pistons each have a forward end face; and in which said end faces lie substantially in a common plane extending transverse to a longitudinal axis of the cartridge body.

12. The cartridge defined in claim 1 in which a discharge neck is located at the discharge end of the cartridge and extends between the discharge nozzle and the said discharge end; and in which separate discharge passages extend between the first and second chambers and the neck for permitting the flow of the fluid components from said chambers and into the neck and out of said nozzle.

13. The cartridge defined in claim 1 in which a static mixer is attached to the dispensing nozzle for receiving and mixing the two fluid components to form and dispense a mixed composition from said static mixer.

14. The cartridge defined in claim 1 in which the first and second chambers have cylindrical interiors which extend in a longitudinally extending side-by-side relationship with respect to each other.

15. The cartridge defined in claim 14 in which the first chamber extends forwardly beyond the second chamber a sufficient distance to form said void space forwardly of a forward end face of the first piston upon both of said pistons reaching the forward end of the cartridge body.

16. The cartridge defined in claim 1 in which the first and second pistons each have an end face; and in which the end face of the first piston is rearward of the end face of the second piston which provides the void space for collecting the flexible film therein upon said pistons reaching the discharge end of the cartridge body.

17. A cartridge for use in a dispensing device for dispensing and mixing a pair of chemically reactive fluid components contained in first and second chambers formed in said cartridge, one of the chambers being formed within a hollow tube located within a hollow interior of the cartridge, with the other of said chambers being formed within the hollow interior of the cartridge coaxial with and surrounding said one chamber;

first and second pistons slidably movably mounted within the first and second chambers respectively, for discharging the fluid components from said chambers as said pistons move simultaneously forward in their respective chambers toward a discharge end of the cartridge, said first piston being annular having a central opening, and the second piston being located within the central opening of said first piston; and a void formed forwardly of said first piston for receiving a collapsible flexible container therein permitting said pistons to reach the full extent of their strokes at the discharge end to expel all of the fluid components from the chambers, wherein one of said components was in the flexible container, each of the pistons having a front end surface with the front end surface of the second piston being offset forwardly from the front end surface of the first piston to form the void therebetween.

18. A cartridge for use in a dispensing gun for simultaneously dispensing two fluid components contained separately in said cartridge, said cartridge including:

a body having a forward discharge end and a rear end, and first and second chambers for containing the two fluid components separate from each other prior to dispensing said components from said chambers, said first chamber being formed by a substantially cylindrical wall extending coaxially throughout the second chamber;

a dispensing nozzle extending from the forward end of the body;

first and second pistons located within the first and second chambers, respectively, and movable from adjacent the rear end of the body toward the discharge end for simultaneously discharging the two fluid components from interiors of said chambers and outwardly through the nozzle, said second piston being annular and slidably movable along the exterior of the cylindrical wall of the inner chamber;

a collapsible container formed of a thin flexible film for storing a first fluid component of said two fluid components within the first chamber; and said first and second pistons having outer end faces with the outer end face of the first piston being spaced rearwardly from the outer end face of the second piston providing means for forming a void space in the first chamber adjacent the forward end of the body having a sufficient volume for collecting the flexible film therein after both outer end faces of the pistons simultaneously reach said forward end to dispense substantially all of the fluid components from the chambers and the first piston has compacted the film in said void space.

19. A cartridge for use in a dispensing gun for simultaneously dispensing two fluid components contained separately in said cartridge, said cartridge including:

a body having a forward discharge end wall and a rear end, and first and second chambers for containing the two fluid components separate from each other prior to dispensing said components from said chambers, said first chamber being formed by a substantially cylindrical wall extending coaxially throughout the second chamber;

a dispensing nozzle extending from the forward end of the body;

first and second pistons located within the first and second chambers, respectively, and movable from adjacent the rear end of the body toward the discharge end for simultaneously discharging the two fluid components from interiors of said chambers and outwardly through the nozzle, said second piston being annular and slidably movable along the exterior of the cylindrical wall of the inner chamber;

a collapsible container formed of a thin flexible film for storing a first fluid component of said two fluid components within the first chamber; and said first chamber extending forwardly beyond the end wall of the cartridge body a sufficient distance forming a void space in the first chamber adjacent the forward end of the body having a sufficient volume for collecting the flexible film therein after both of the pistons have reached said forward end to dispense substantially all of the fluid components from the chambers and the first piston has compacted the film in said void space.

20. A cartridge for use in a dispensing gun for simultaneously dispensing two fluid components contained separately in said cartridge, said cartridge including:

a body having a forward discharge end and a rear end, and first and second chambers for containing the two fluid components separate from each other prior to dispensing said components from said chambers, said first and second chambers having cylindrical interiors which extend in a longitudinally extending side-by-side relationship with respect to each other;

a dispensing nozzle extending from the forward end of the body;

first and second pistons located within the first and second chambers, respectively, and movable from adjacent the rear end of the body toward the discharge end for simultaneously discharging the two fluid components from interiors of said chambers and outwardly through the nozzle;

a collapsible container formed of a thin flexible film for storing a first fluid component of said two fluid components within the first chamber; and said first chamber extending forwardly beyond the second chamber a sufficient distance to form a void space forwardly of a forward end face of the first piston upon both of said pistons reaching the forward discharge end of the cartridge body, said void space having a sufficient volume for collecting the flexible film therein after both of the pistons have reached said forward end to dispense substantially all of the fluid components from the chambers and the first piston has compacted the film in said void space.

21. A cartridge for use in a dispensing gun for simultaneously dispensing two fluid components contained separately in said cartridge, said cartridge including:

a body having a forward discharge end and a rear end, and first and second chambers for containing the two fluid components separate from each other prior to dispensing said components from said chambers;

a dispensing nozzle extending from the forward end of the body;

first and second pistons, each having an end face, located within the first and second chambers, respectively, and movable from adjacent the rear end of the body toward the discharge end for simultaneously discharging the two fluid components from interiors of said chambers and outwardly through the nozzle;

a collapsible container formed of a thin flexible film for storing a first fluid component of said two fluid components within the first chamber; and said end face of the first piston being rearward of the end face of the second piston to form a void space in the first chamber adjacent the forward end of the body having a sufficient volume for collecting the flexible film therein after both of the pistons have reached said forward end to dispense substantially all of the fluid components from the chambers and the first piston has compacted the film in said void space.

* * * * *